US010881903B2

(12) United States Patent
An

(10) Patent No.: US 10,881,903 B2
(45) Date of Patent: Jan. 5, 2021

(54) HAND GRIP

(71) Applicant: Tae Jin An, Incheon (KR)

(72) Inventor: Tae Jin An, Incheon (KR)

( * ) Notice: Subject to any disclaimer, the term of this patent is extended or adjusted under 35 U.S.C. 154(b) by 9 days.

(21) Appl. No.: 16/282,563

(22) Filed: Feb. 22, 2019

(65) Prior Publication Data

US 2019/0255383 A1 Aug. 22, 2019

(30) Foreign Application Priority Data

Feb. 22, 2018 (KR) ..... 10-2018-0021182

(51) Int. Cl.

| | |
|---|---|
| ***A63B 23/16*** | (2006.01) |
| ***A63B 21/00*** | (2006.01) |
| ***A63B 21/02*** | (2006.01) |
| ***A63B 21/04*** | (2006.01) |

(52) U.S. Cl.

CPC ..... *A63B 23/16* (2013.01); *A63B 21/00072* (2013.01); *A63B 21/023* (2013.01); *A63B 21/0421* (2013.01)

(58) Field of Classification Search

CPC ..... A63B 23/16; A63B 21/023; A63B 21/05; A63B 21/03; A63B 21/0421; A63B 21/00072

See application file for complete search history.

(56) References Cited

U.S. PATENT DOCUMENTS 1,638,196 A * 8/1927 Guth ..... A63B 21/0004 482/38
3,075,769 A * 1/1963 Cunningham ..... A63B 23/16 473/511

(Continued)

FOREIGN PATENT DOCUMENTS

CN 1226062 C 11/2005
KR 100522449 B1 10/2005

(Continued)

OTHER PUBLICATIONS

Office Action issued in corresponding Korean Application No. 10-2018-0021182 dated Mar. 19, 2019 (6 pages).

(Continued)

*Primary Examiner* — Jennifer Robertson
*Assistant Examiner* — Catrina A Letterman
(74) *Attorney, Agent, or Firm* — Osha Bergman Watanabe & Burton LLP

(57) ABSTRACT

Provided is a hand grip including a first and second operating arms capable of moving toward and away from each other, a first and second connection arms disposed between the first and second operating arms to be inclined, of which both ends rotatably connected to the first and second operating arms, a spring member installed to provide an elastic force in a direction interfering with approach of the first and second operating arms, a spring fixing part formed to extend upward from the first operating arm and to which one end of the spring member is fixed, a spring connection part formed to extend from an upper end of the first connection arm and to which the other end of the spring member is fixed, and a strength adjusting part formed in the spring connection part and configured to allow the other end of the spring member to move.

4 Claims, 7 Drawing Sheets

(56) References Cited

U.S. PATENT DOCUMENTS

| | | | | | |
|---|---|---|---|---|---|
| 4,726,580 | A * | 2/1988 | Batiste | A63B 21/05 | 482/122 |
| 5,409,436 | A * | 4/1995 | Chang | A63B 23/16 | 482/121 |
| 6,881,177 | B2 * | 4/2005 | An | A63B 21/0004 | 482/121 |
| 7,824,311 | B1 * | 11/2010 | Hsu | A63B 21/4047 | 482/126 |
| 8,133,158 | B2 * | 3/2012 | An | A63B 21/0004 | 482/49 |
| 2008/0103026 | A1 | 5/2008 | An | | |
| 2010/0255956 | A1 | 10/2010 | An | | |
| 2016/0354628 | A1 * | 12/2016 | Hao | A63B 23/0355 | |

FOREIGN PATENT DOCUMENTS

| | | | |
|---|---|---|---|
| KR | 2008-0063260 | A | 7/2008 |
| KR | 2009-0023069 | A | 3/2009 |
| KR | 101020194 | B1 | 3/2011 |

OTHER PUBLICATIONS

Office Action issued in corresponding Chinese Application No. 201910130568.8, dated May 29, 2020 (14 pages).

* cited by examiner

HAND GRIP

CROSS-REFERENCE TO RELATED APPLICATION

This application claims priority to and the benefit of Korean Patent Application No. 2018-0021182, filed on Feb. 22, 2018, the disclosure of which is incorporated herein by reference in its entirety.

BACKGROUND

1. Field of the Invention

The present disclosure relates to a hand grip, and more specifically, to a hand grip configured to provide an elastic force to a direction opposite to a direction in which two operating arms approach each other to allow muscular strength improving exercise.

2. Discussion of Related Art

A hand grip is exercise equipment used to train muscular strength of hands or forearms and is convenient to handle and carry due to a small size thereof and thus can be easily used anywhere and at any time.

A user holds the hand grip with one hand and repeats a releasing operation which presses a pair of operating arms and removes power so that the operating arms approach each other. Muscular strength of hands or arms is improved by an operation of repetitively applying a force to overcome an elastic force provided by a spring.

Conventionally, a hand grip having a configuration in which a pair of operating arms are rotatably coupled to a hinge point and a spring member is installed on or under the hinge point is disclosed. However, in the case of the above-described hand grip, since an operation of the operating arms is rotating exercise on the basis of a rotary shaft, power is not uniformly dispersed throughout the palm during exercise. In order to solve the above-described disadvantage, an inventor provides a hand grip having a structure in which a pair of operating arms are connected by two link arms and thus exercise can be performed in a manner in which the pair of operating arms approach and are spaced apart in parallel with each other during gripping exercise.

(Patent Document 1) Korean Application Patent No. 10-1020194 (Feb. 28, 2011)

SUMMARY OF THE INVENTION

The present disclosure is directed to providing a hand grip having a structure in which exercise is performed in a manner in which a pair of operating arms approach and are spaced apart in parallel with each other and strength of an elastic force is conveniently adjusted according to muscular strength of a user.

Also, the present disclosure is directed to providing a hand grip having a structure in which strength of an elastic force is conveniently adjusted according to muscular strength of a user and a distance between operating arms is adjusted according to sizes of hands of the user.

According to an aspect of the present disclosure, there is provided a hand grip including: a first operating arm and a second operating arm connected to perform approaching and separation movement; a first connection arm disposed between the first operating arm and the second operating arm to be inclined and having both ends rotatably connected to the first operating arm and the second operating arm; a second connection arm disposed under the first connection arm to be inclined in a direction which is the same as that of the first connection arm and having both ends rotatably connected to the first operating arm and the second operating arm; a spring member installed to provide an elastic force in a direction interfering with approach of the first operating arm and the second operating arm; a spring fixing part formed to extend upward from the first operating arm and to which one end of the spring member is fixed; a spring connection part formed to extend to one side from an upper end of the first connection arm to operate together with the first connection arm and to which the other end of the spring member is fixed; and a strength adjusting part formed in the spring connection part and configured to allow a position of the other end of the spring member to move.

According to an embodiment the present disclosure, the strength adjusting part may include a rotating engaging member rotatably installed along a longitudinal direction of a hollow hole of the spring connection part and having a knob configured to allow a rotating operation, and a moving part coupled to the rotating engaging member to move along an axial line direction of the rotating engaging member during rotation of the rotating engaging member and to which the other end of the spring member is fixed.

According to the embodiment the present disclosure, the hand grip may further include a gap adjusting part including an insertion hole formed at one side of the first operating arm, and a rotation restriction member coupled to the first operating arm through the insertion hole to adjust a coupling depth and configured to restrict a rotating range in a returning direction of the first connection arm in a release state in which an end portion comes into contact with the upper end of the first connection arm and thus a force applied to the first operating arm and the second operating arm is removed.

According to another aspect of the present disclosure, there is provided a hand grip including: a first operating arm and a second operating arm connected to perform approaching and separation movement; a spring member installed to provide an elastic force in a direction interfering with approach of the first operating arm and the second operating arm; a spring fixing part formed to extend upward from the first operating arm and to which one end of the spring member is fixed; a spring connection part formed to extend to one side from an upper end of the second operating arm and to which the other end of the spring member is fixed; a strength adjusting part formed in the spring connection part to allow a position of the other end of the spring member to move, and including a rotating engaging member rotatably installed along a longitudinal direction of a hollow hole of the spring connection part and having a knob configured to allow a rotating operation and a moving part coupled to the rotating engaging member to move along an axial line direction of the rotating engaging member during rotation of the rotating engaging member and to which the other end of the spring member is fixed; and a gap adjusting part including an insertion hole formed at one side of the first operating arm and a rotation restriction member coupled to the first operating arm through the insertion hole to adjust a coupling depth and configured to restrict a rotating range of the first operating arm in a returning direction in a release state in which an end portion comes into contact with the upper end of the first operating arm and thus a force applied to the first operating arm and the second operating arm is removed.

According to the embodiment the present disclosure, the insertion hole may include a nut part having a screw thread on an inner diameter, the rotation restriction member may include a bolt body part screw-engaged with the nut part, and a compression spring, which has one end supported at a rotating knob configured to allow a rotating operation of the rotation restriction member and provides an elastic force against an engaging direction of the rotation restriction member, may be installed in the rotation restriction member.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
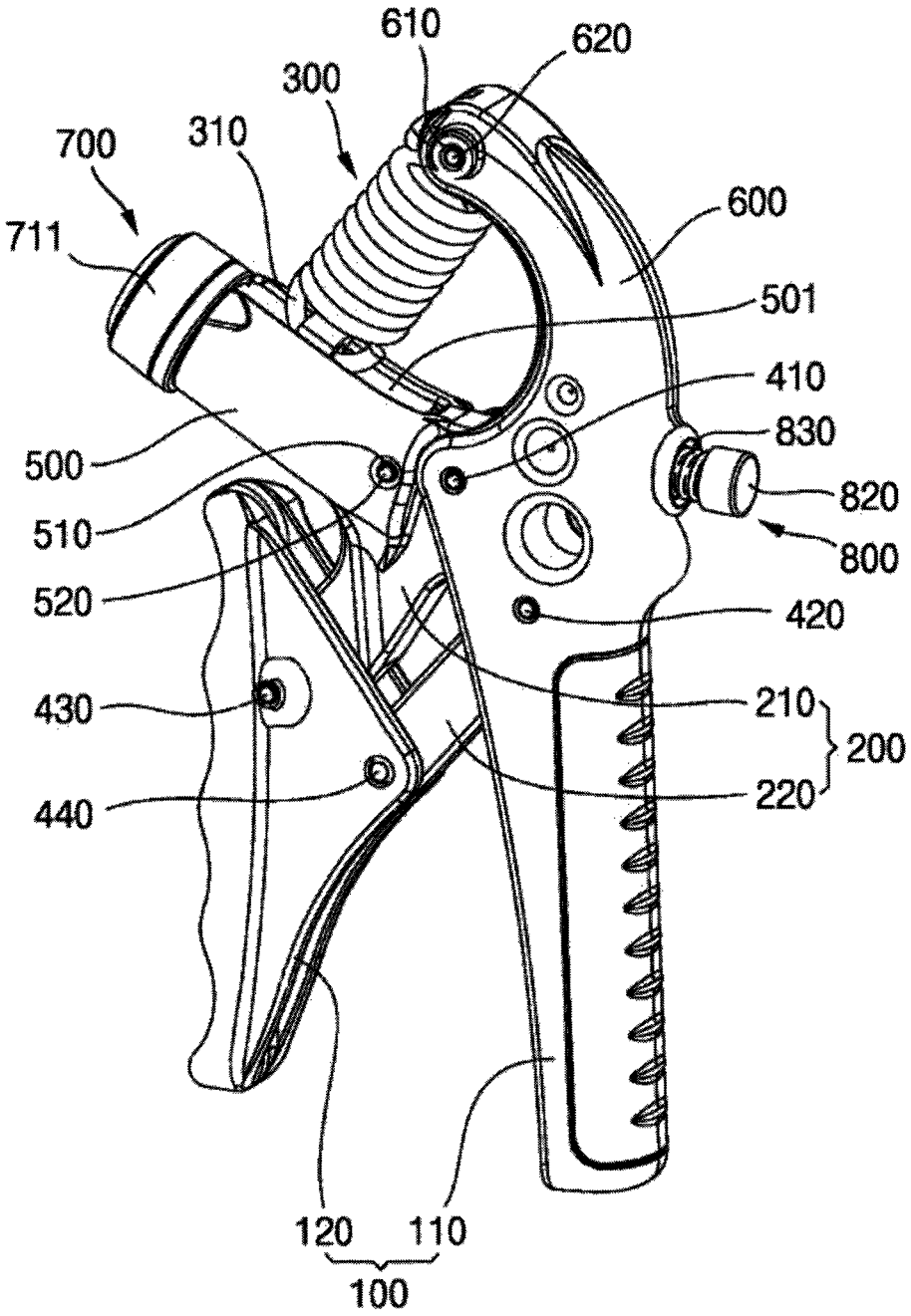
FIG. 1 is a perspective view illustrating a hand grip according to an embodiment of the present disclosure.

Since the present disclosure may be variously changed and have various embodiments, particular embodiments will be exemplified in the drawings and described. However, the present disclosure is not limited to the particular embodiments and includes all changes, equivalents, and substitutes falling within the spirit and the scope of the present disclosure. Similar reference numerals are used for similar elements in a description of the drawings.

The terms are only used to distinguish one element from another. Terms used in the present disclosure are just used to describe the particular embodiments and not to limit the present disclosure. The singular form is intended to also include the plural form, unless the context clearly indicates otherwise.

Hereinafter, embodiments of the present disclosure will be described in detail with reference to the accompanying drawings.

Figure 2:
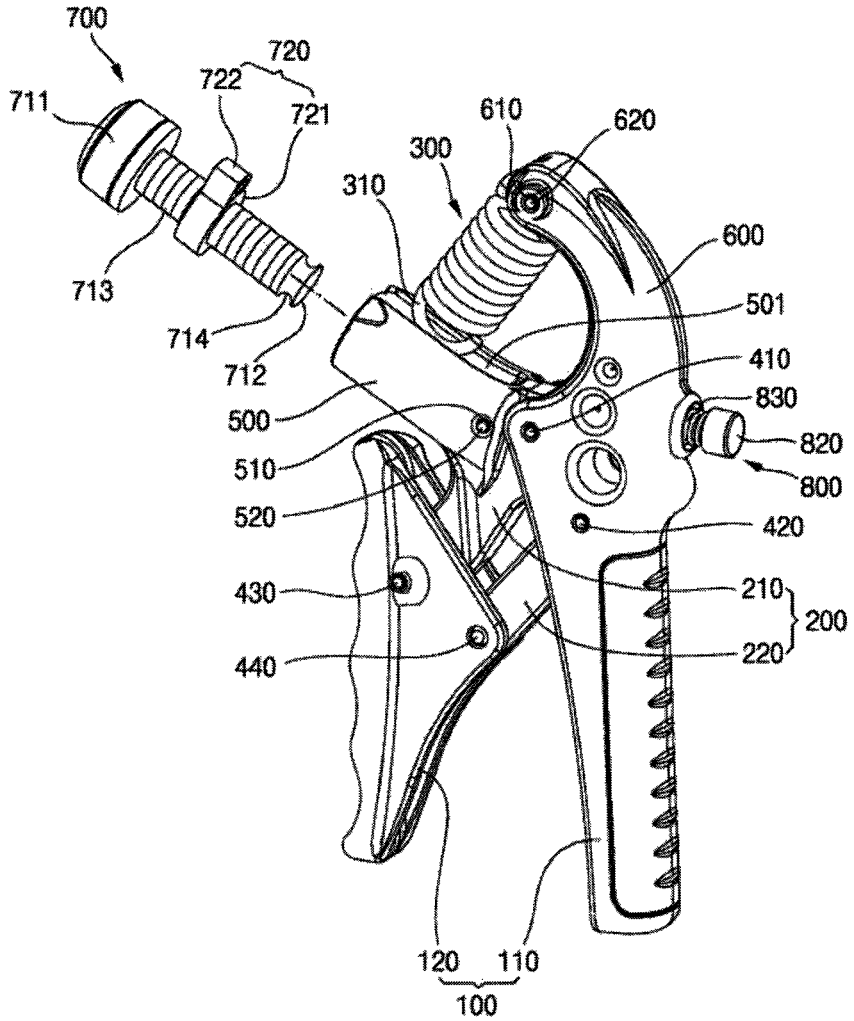
FIG. 2 is a partially exploded perspective view for describing a strength adjusting part in the hand grip according to the embodiment of the present disclosure.
Figure 3:
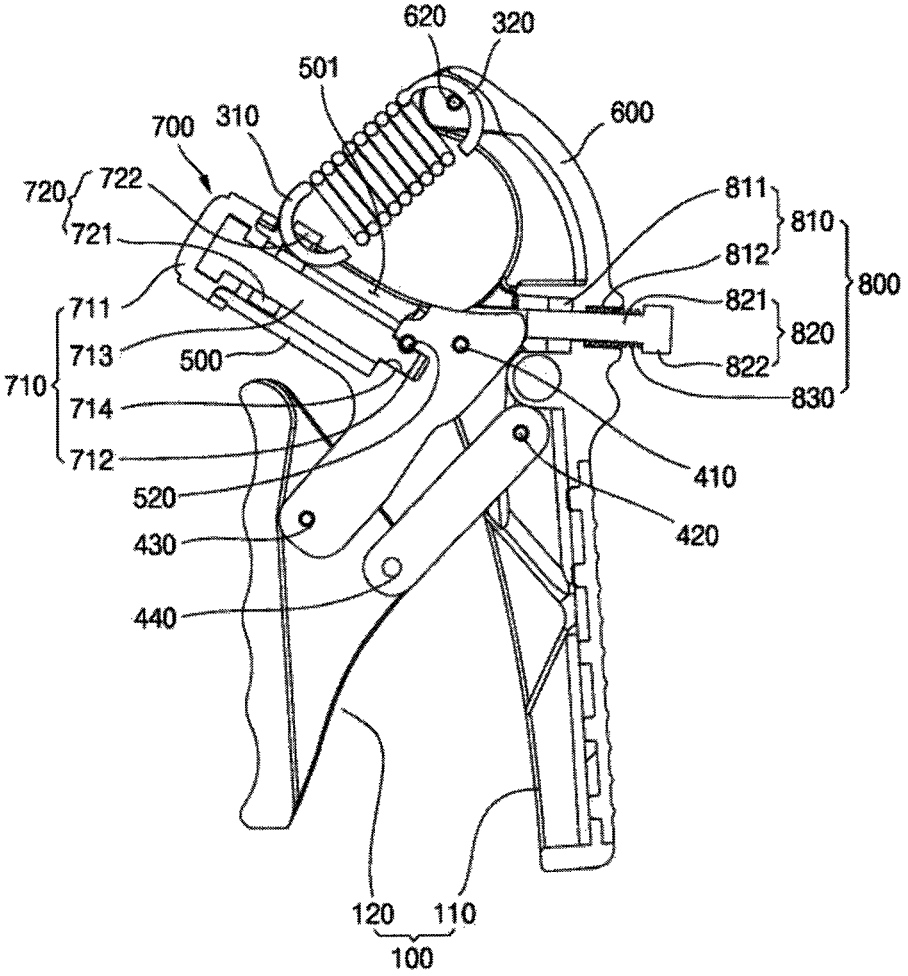
FIGS. 3 and 4 are cross-sectional views for describing a method of adjusting strength in the hand grip according to the embodiment of the present disclosure.
Figure 4:
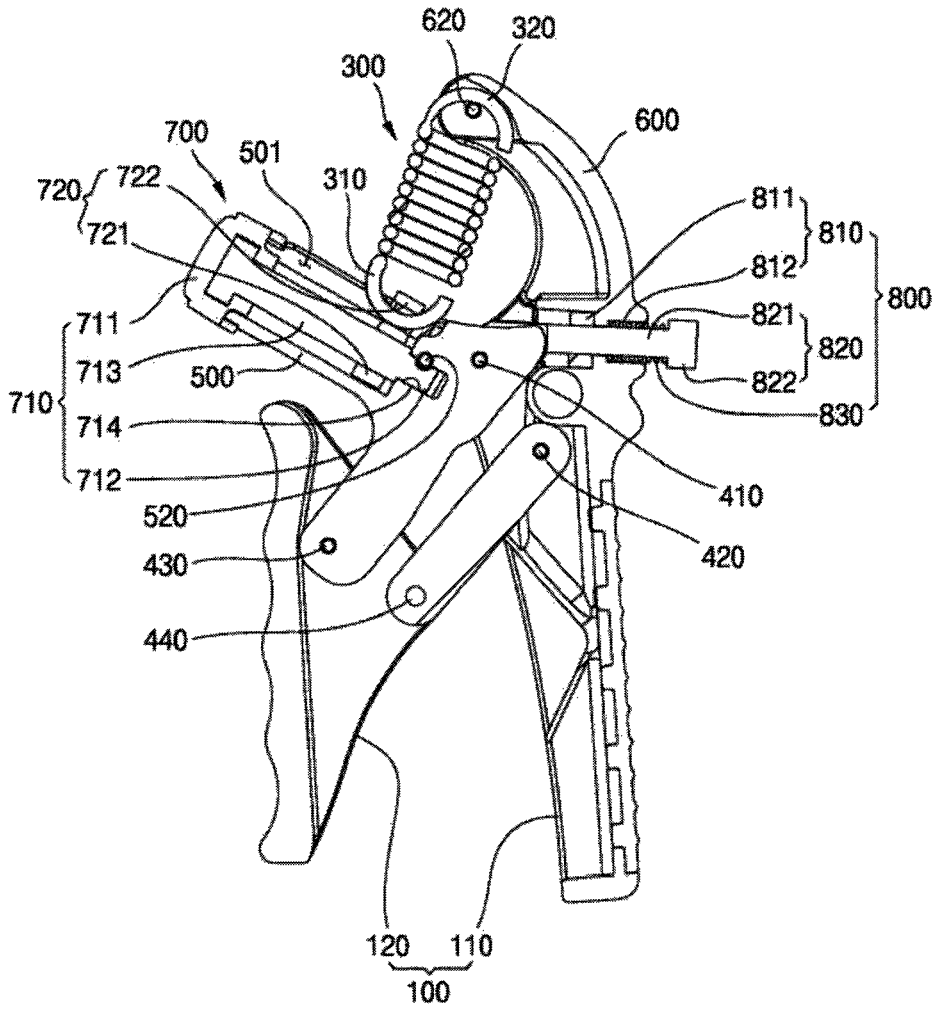

FIG. 1 is a perspective view illustrating a hand grip according to an embodiment of the present disclosure, FIG. 2 is a partially exploded perspective view for describing a strength adjusting part in the hand grip according to the embodiment of the present disclosure, and FIGS. 3 and 4 are cross-sectional views for describing a method of adjusting strength in the hand grip according to the embodiment of the present disclosure.

The hand grip according to the embodiment of the present disclosure includes a pair of operating arms 100 and connection arms 200 configured to connect the pair of operating arms 100 so that the operating arms 100 approach and are spaced apart in parallel with each other, and includes a strength adjusting part 700 configured to change the magnitude of a force necessary to operate the operating arms 100 by moving a position of an end portion of a spring member 300 to change the magnitude of an elastic force provided by the spring member 300.

The pair of operating arms 100 are disposed to be spaced apart from each other and include a first operating arm 110 and a second operating arm 120 connected to be capable of performing approaching and separation movement.

The first operating arm 110 and the second operating arm 120 are formed with a gap which is wide enough so as to be gripped by one hand of a user, and the first operating arm 110 and the second operating arm 120 are connected to each other by the connection arms 200.

A structure which may be held by the hand of the user and prevent a slip during exercise may be formed in each of the first operating arm 110 and the second operating arm. For example, a rubber pad configured to prevent a slip may be attached to the first operating arm 110, and a gripping part having a bent shape and a plurality of grooves may be formed on the second operating arm 120 to be easily gripped by fingers. Exercise may be performed in a state in which the first operating arm 110 is supported by a palm and the second operating arm 120 is gripped by fingers.

The first operating arm 110 and the second operating arm 120 are connected to each other by at least two connection arms 200. According to the embodiment of the present disclosure, the connection arms 200 include a first connection arm 210 and a second connection arm 220 disposed in order between the first operating arm 110 and the second operating arm 120 in an inclined manner.

Both ends of each of the first connection arm 210 and the second connection arm 220 are rotatably connected between the first operating arm 110 and the second operating arm 120 through rotary shafts. Specifically, the first connection arm 210 is rotatably connected to the first operating arm 110 by a first upper rotary shaft 410 and is rotatably connected to the second operating arm 120 by a first lower rotary shaft 430. The second connection arm 220 is rotatably connected to the first operating arm 110 by a second upper rotary shaft 420 and is rotatably connected to the second operating arm 120 by a second lower rotary shaft 440. The second connection arm 220 is disposed under the first connection arm 210 to be inclined in a direction the same as that of first connection arm 210. Accordingly, the first connection arm 210 and the second connection arm 220 are disposed to be parallel with each other.

A spring fixing part 600 to which one end of the spring member 300 is fixed is formed at an upper portion of the first operating arm 110.

A spring connection part 500 is formed to extend to one side of the first connection arm 210 through an upper end of the first connection arm 210, that is, the first upper rotary shaft 410 which is a connection portion in which the first connection arm 210 is connected to the first operating arm 110. Accordingly, the other end of the spring member 300 is fixed to the spring connection part 500 and the spring connection part 500 operates integrally with the first connection arm 210.

According to the present disclosure, when the user grips the first operating arm 110 and the second operating arm 120 with one hand and applies a force, the second operating arm 120 approaches the first operating arm 110 while the first operating arm 110 and the second operating arm 120 maintain the state of being parallel with each other. Further, when the user removes the force in a state in which the force is applied to the first operating arm 110 and the second operating arm 120, the second operating arm 120 is spaced apart from the first operating arm 110 in a state of being parallel with the first operating arm 110 and enters a release state. Accordingly, the force applied to the first operating arm 110 and the second operating arm 120 is uniformly dispersed on an entire palm by the spring member 300 fixed between the spring connection part 500 and the spring fixing part 600.

As described above, when the exercise is performed using the hand grip according to the present disclosure, since approaching and separation parallel movement is repeated in a state in which the first operating arm 110 and the second operating arm 120 are parallel with each other, an upper portion and a lower portion of the second operating arm 120 apply a force uniformly to all four fingers and thus the force is uniformly provided on the entire palm during gripping exercise.

The hand grip according to the embodiment of the present disclosure is formed to be capable of adjusting strength of the spring member 300.

The spring member 300 is fixed between the spring fixing part 600 configured to operate together with the first operating arms 110 and the spring connection part 500 configured to operate together with the second operating arms 120 through the first connection arm 210.

The spring member 300 may be a coil-shaped tensile spring. The spring member 300 provides an elastic force, which is caused by tension when the first operating arm 110 and the second operating arm 120 approach each other, to the first operating arm 110 and the second operating arm 120.

According to the embodiment of the present disclosure, the strength adjusting part 700 configured to move the position of the other end of the spring member 300 to allow strength of the elastic force provided when the first operating arm 110 and the second operating arm 120 approach each other is provided in the spring connection part 500 to which the other end of the spring member 300 is fixed.

The strength adjusting part 700 includes a rotating engaging part 710 installed to be rotatable along a longitudinal direction of the spring connection part 500 and a moving part 720 coupled to the rotating engaging part 710 to move along an axial line direction of the rotating engaging part 710 during rotation of the rotating engaging part 710 and to which the end portion of the spring member 300 is fixed.

The rotating engaging part 710 is installed along a hollow hole formed in the spring connection part 500. The rotating engaging part 710 includes a shaft part 713 having a screw thread at the outside thereof and a knob 711 provided on one end of the shaft part 713 and exposed to the outside to allow the user to operate rotation of the shaft part 713. An insertion end 712 inserted into a supporting groove formed in an end portion of the hollow hole of the spring connection part 500 is formed at the other end of the shaft part 713, and a pin insertion groove portion 714 is formed on the insertion end 712 in a ring shape along an outer circumferential surface of the insertion end 712.

Since a fixing pin 520 is inserted through a pin hole 510 formed in the spring connection part 500 and is inserted into the pin insertion groove portion 714 of the rotating engaging part 710, the rotating engaging part 710 is rotatably installed at a regular position.

The moving part 720 includes a moving piece 721 screw-coupled to the shaft part 713 of the rotating engaging part 710 and movable by the rotation of the rotating engaging part 710 and a coupling portion 722 provided on the moving piece 721 and engaged with a first engaging end portion 310 of the spring member 300.

A guide slot 501 is formed in an outer surface of the spring connection part 500 in an installation direction of the spring member 300, and the engaging portion 722 moves along the guide slot 501 in a state of fixing the first engaging end portion 310 of the spring member 300 thereto due to rotation of the knob 711.

A second engaging end portion 320 of the spring member 300 is formed to be fixable to an end portion of the spring fixing part 600 formed upward from the first operating arm 110. Specifically, a pin accommodation hole 610 is formed in the end portion of the spring fixing part 600, and the second engaging end portion 320 of the spring member 300 is fixed to a fixing pin 620 installed through the pin accommodation hole 610.

When the knob 711 is adjusted, the moving piece 721 is movable on the spring connection part 500 along the shaft part 713 of the rotating engaging part 710. Further, when a position of one side end portion of the spring member 300 is changed by the moving piece 721, the strength of the elastic force provided by the spring member 300 during exercise using the first operating arm 110 and second operating arm 120 may be adjusted.

The hand grip according to the embodiment of the present disclosure is configured to restrict elastic rotation of the first connection arm 210 to be capable of adjusting a gap between the operating arms 100.

Figure 5:
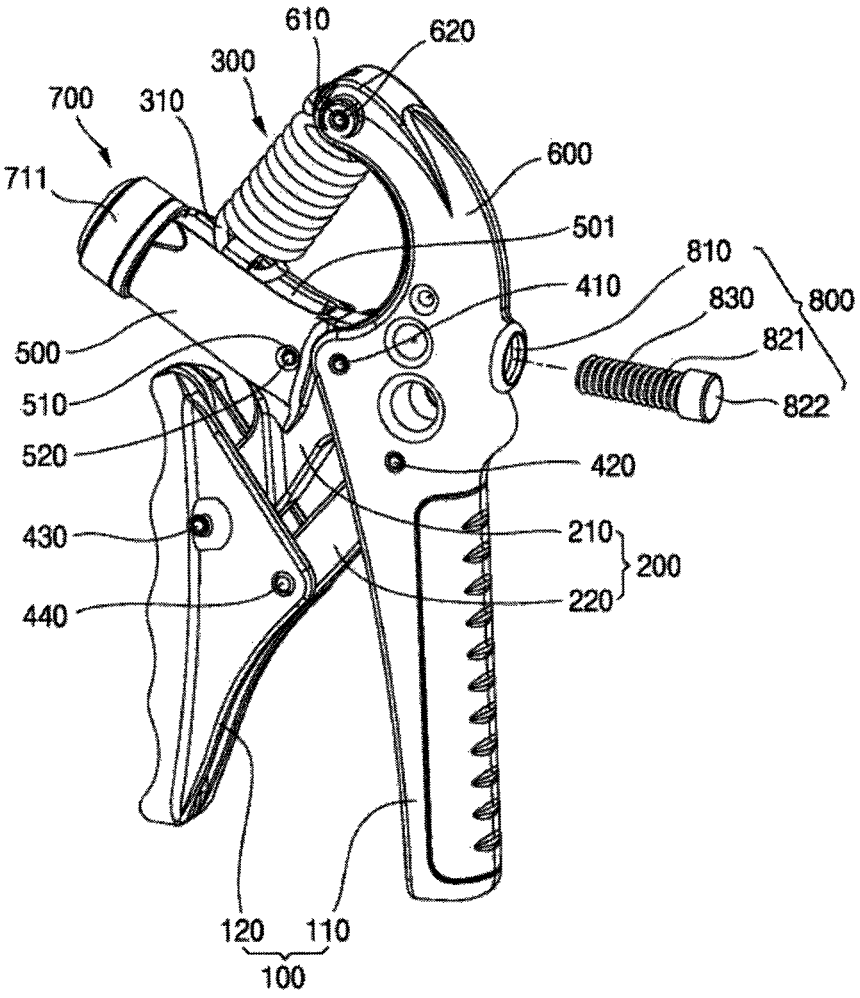
FIG. 5 is a partially exploded perspective view for describing a gap adjusting part of the hand grip according to the embodiment of the present disclosure.
Figure 6:
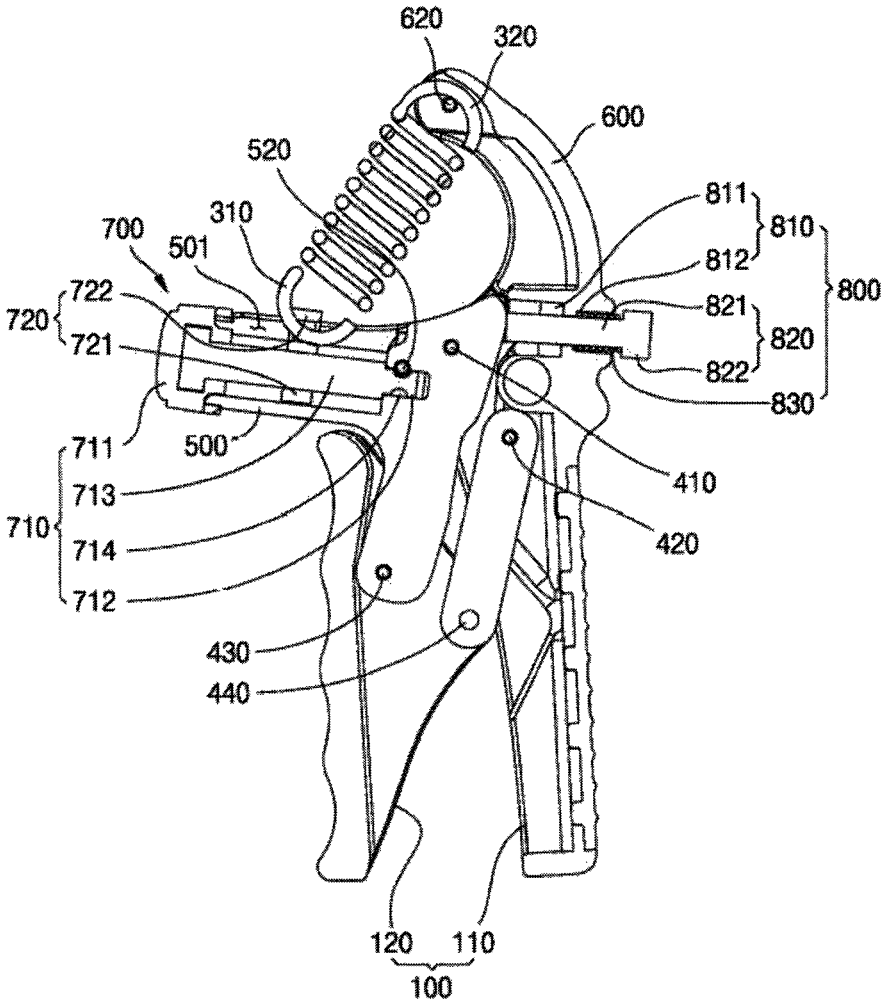
FIGS. 6 and 7 are views for describing a method of adjusting a gap between operating arms in the hand grip according to the embodiment of the present disclosure.
Figure 7:
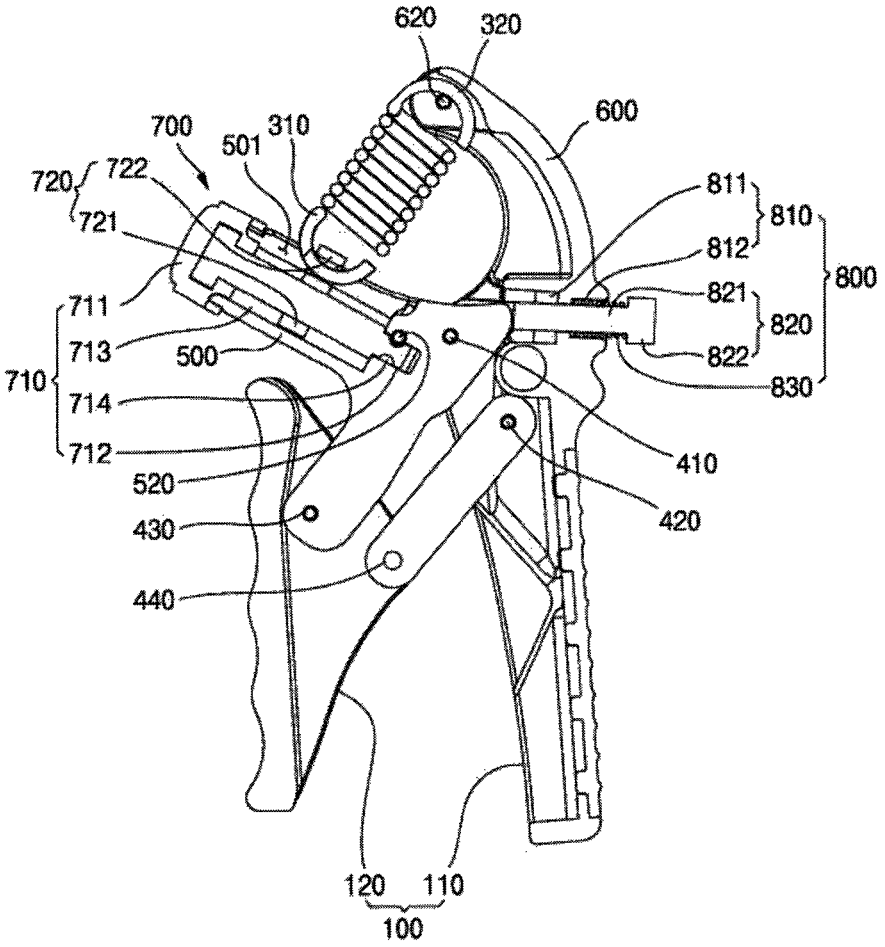

FIGS. 5 to 7 are views for describing a configuration and gap adjusting method of the gap adjusting part in the hand grip according to the embodiment of the present disclosure.

According to the embodiment of the present disclosure, a gap adjusting part 800 includes an insertion hole 810 formed in one side of the first operating arm 110 and a rotation restriction member 820 which is inserted through the insertion hole 810 and comes into contact with the first connection arm 210 to restrict a rotating range of the first connection arm 210 on the basis of the first upper rotary shaft 410.

According to the embodiment of the present disclosure, the rotation restriction member 820 may be implemented as a bolt and, accordingly, includes a bolt body part 821 on which a screw thread is formed. Further, the rotation restriction member 820 includes a rotating knob 822 exposed to the outside from one side of the bolt body part 821 and configured to allow the user to adjust rotation of the bolt body part 821. An end of the bolt body part 821 comes into contact with the upper end of the first connection arm 210.

The insertion hole 810 includes a nut part 811 with which the bolt body part 821 of the rotation restriction member 820 implemented in a bolt shape is engaged and a spring insertion groove 812 in which a compression spring 830 is installed. The spring insertion groove 812 is formed at an inlet of the insertion hole 810 to have an inner diameter greater than a diameter of the bolt body part 821 so that the compression spring 830 may be insertion-installed therein. Accordingly, the rotation restriction member 820 may be easily installed in the insertion hole 810 in a state in which the compression spring 830 is wound around the bolt body part 821. However, the compression spring 830 may be installed without forming the spring insertion groove 812.

The compression spring 830 provides an elastic force in a direction opposite a direction in which the rotation restriction member 820 is engaged in a state in which one end of the compression spring 830 is supported on the rotating knob 822. Accordingly, the bolt-shaped rotation restriction member 820 is prevented from arbitrary rotation due to an arbitrary impact applied to the outside or movement of the hand grip. Since the screw thread of the bolt body part 821 of the rotation restriction member 820 comes into close contact with a screw thread of the nut part 811 without an empty space due to a compressing force of the compression spring 830, the rotation restriction member 820 may be prevented from the arbitrary rotation in a state in which a rotating force is not applied to the rotation restriction member 820.

According to the present disclosure, since the rotation restriction member 820 restricts the rotating range of the first connection arm 210 according to a depth by which the rotation restriction member 820 is inserted through the insertion hole 810, the gap between the first operating arm 110 and the second operating arm 120 may be adjusted.

Referring to FIGS. 6 and 7, a gap between the first operating arm 110 and the second operating arm 120 shown in FIG. 6 may be confirmed to be smaller than a gap between the first operating arm 110 and the second operating arm 120 shown in FIG. 7.

When the user holds the first operating arm 110 and the second operating arm 120 and applies a force, the first operating arm 110 and the second operating arm 120 approach each other and the spring member 300 is elongated, and when the force is removed, the first operating arm 110 and the second operating arm 120 are spaced apart from each other again in the release state. When the first operating arm 110 and the second operating arm 120 are spaced apart from each other, the first connection arm 210 rotates in a clockwise direction on the basis of the first upper rotary shaft 410, and an end portion of the rotation restriction member 820 comes into contact with the upper end of the first connection arm 210 and restricts clockwise rotation of the first connection arm 210 to restrict rotation of a returning direction of the first connection arm 210, and accordingly, since a distance in which the second operating arm 120 approaches the first operating arm 110 is adjusted, the gap between the first operating arm 110 and the second operating arm 120 may be adjusted.

Meanwhile, according to another embodiment of the present disclosure, a hand grip without connection arms 200 may also be provided with a gap adjusting part identical to that in the embodiment of the present disclosure.

According to another embodiment of the present disclosure, the hand grip of another embodiment of the present disclosure is the same as the hand grip of the first embodiment of the present disclosure except for connection of a first operating arm and a second operating arm on the basis of a rotary shaft. Accordingly, a rotation restriction member inserted through an insertion hole may adjust the gap between the operating arm and the second operating arm by coming into contact with an upper side surface of the first operating arm and regulating a rotating range of the first operating arm in a returning direction in the release state.

An operation of the above-described hand grip according to the present disclosure will be described below.

In the hand grip according to the embodiment of the present disclosure, strength of an elastic force provided by the spring member 300 during the gripping exercise may be adjusted.

When a user having a relatively strong gripping force desires to use the hand grip of the present disclosure, the knob 711 of the rotating engaging part 710 is rotated in one direction so that the moving part 720 to which the one end of the spring member 300 is fixed moves in a direction far from the first upper rotary shaft 410, that is, a direction close toward the knob 711. When the first engaging end portion of the spring member 300 coupled to the coupling portion 722 of the moving part 720 moves toward the knob 711, a force necessary for approaching movement of the operating arms 100, that is, strength of the hand grip, increases.

When a user having a relatively weak gripping force desires to use the hand grip of the present disclosure, the knob 711 of the rotating engaging part 710 is rotated in a direction opposite the above-described one direction so that the moving part 720 moves toward the first upper rotary shaft 410. Accordingly, the strength of the hand grip decreases.

Accordingly, in the present disclosure, the strength of the hand grip may be adjusted to use the hand grip according to strength of the gripping force of the user.

In the hand grip according to the embodiment of the present disclosure, the gap between the pair of operating arms 100 may be adjusted according to the size of the hand.

In order to narrowly adjust the gap between the first operating arm 110 and the second operating arm 120, the rotation restriction member 820 is inserted through the insertion hole 810 after the first operating arm 110 and the second operating arm 120 approach each other. Accordingly, since the end portion of the rotation restriction member 820 comes into close contact with the upper side surface of the first connection arm 210 and the clockwise rotation of the first connection arm 210 in the release state is restricted, movement of the second operating arm 120 connected to the first connection arm 210 in the release state is restricted. Accordingly, the gap between the first operating arm 110 and the second operating arm 120 may be adjusted to be narrow.

When the rotation restriction member 820 engaged with the insertion hole 810 is taken out to the outside, since the end portion of the rotation restriction member 820 comes into contact with the upper side surface of the first connection arm 210 in a state in which the first connection arm 210 rotates relatively further, the gap between the first operating arm 110 and the second operating arm 120 may be broadly adjusted. In comparison with FIGS. 6 and 7, since an engaging depth of the rotation restriction member 820 through the insertion hole 810 is changed, the gap between the first operating arm 110 and the second operating arm 120 in the release state may be confirmed to be adjusted. Accordingly, the gap between the operating arms of the hand grip may be adjusted according to the size of the hand of the user to use the hand grip.

In a hand grip according to the above-described embodiment of the present disclosure, since exercise between a pair of operating arms is not rotating exercise on the basis of a hinge point but one operating arm performs linear translation in a state in which two operating arms are parallel with each other, power is uniformly dispersed on an entire palm during muscular strength exercise and strength of the hand grip can be adjusted according to muscular strength of a user by adjusting a spring member.

In the hand grip according to the embodiment of the present disclosure, everyone can use the hand grip regardless of a hand size by adjusting a gap between the operating arms.

As described above, although the present disclosure is described in detail with exemplary embodiments, the present disclosure is not limited to the above-described embodiments, changes may be made within the scope of each of the claims, detailed descriptions, and the accompanying drawings, and the above may be included in the present disclosure.

What is claimed is:

1. A hand grip comprising:

a first operating arm and a second operating arm connected to perform a movement of approaching each other and being spaced apart from each other;

a first connection arm disposed between the first operating arm and the second operating arm to be inclined and having both ends rotatably connected to the first operating arm and the second operating arm;

a second connection arm disposed under the first connection arm to be inclined in a direction which is the same as that of the first connection arm and having both ends rotatably connected to the first operating arm and the second operating arm;

a spring member installed to provide an elastic force in a direction interfering with approach of the first operating arm and the second operating arm;

a spring fixing part formed to extend integrally upward from the first operating arm, wherein one end of the spring member is fixed to an upper end of the spring fixing part;

a spring connection part formed integrally with the first connection arm and extending obliquely from an upper side of the first connection arm in an outer direction of the hand grip, wherein the spring connection part has a strength adjusting part to which the other end of the spring member is fixed and the spring member is obliquely disposed between the spring fixing part and the spring connection part, and wherein when the first and second operating arms approach each other the spring connection part rotates away from the spring fixing part about a first upper rotary shaft connecting the first operating arm and the first connection arm;

wherein the strength adjusting part is formed in the spring connection part along the longitudinal direction of the spring connection part and configured to adjust the strength of the spring member by adjusting the position of the other end of the spring member along the longitudinal direction of the spring connection part.

2. The hand grip of claim 1, wherein the strength adjusting part includes:

a rotating engaging member rotatably installed along a longitudinal direction of a hollow hole of the spring connection part and having a knob configured to allow a rotating operation; and a moving part coupled to the rotating engaging member to move along an axial line direction of the rotating engaging member during rotation of the rotating engaging member and to which the other end of the spring member is fixed.

3. The hand grip of claim 1, further comprising a gap adjusting part including:

an insertion hole formed to penetrate the first operation arm from outside to inside of the first operation arm, the insertion hole extending toward the upper side of the first connection arm, a nut part provided in the insertion hole and having a screw thread on an inner diameter; and a rotation restriction member coupled to the first operation arm through the insertion hole, the rotation restriction member including a bolt body part screw-engaged with the nut part and a rotating knob for rotation operation disposed in an end of the rotation restriction member, the rotating knob being positioned in an outer side of the first operation arm;

wherein the rotation restriction member is configured to adjust the depth inserted through the insertion hole by the rotation operation and is configured such that an inner end portion comes into contact with the upper side end of the first connection arm to restrict a rotating range in which the first connection arm rotates in a returning direction in the release state in which the force applied to the first operating arm and the second operating arm is removed.

4. The hand grip of claim 3, wherein:

the gap adjusting part further includes a compression spring being installed in the rotation restriction member, the compression spring being supported between the rotation knob and the first operation arm to provides an elastic force against an engaging direction of the rotation restriction member.

* * * * *